US007934346B2

(12) United States Patent
MacKinnon et al.

(10) Patent No.: US 7,934,346 B2
(45) Date of Patent: May 3, 2011

(54) PROCESS OF TREATING A SYNTHETIC SHINGLE AND SHINGLE MADE THEREBY

(75) Inventors: Thomas Kevin MacKinnon, Ann Arbor, MI (US); Douglas Harold Wylie, Richmond Hill (CA); John K. Donaldson, Newtown Square, PA (US)

(73) Assignee: CertainTeed Corporation, Valley Forge, PA (US)

( * ) Notice: Subject to any disclaimer, the term of this patent is extended or adjusted under 35 U.S.C. 154(b) by 654 days.

(21) Appl. No.: 12/043,185

(22) Filed: Mar. 6, 2008

(65) Prior Publication Data

US 2008/0236079 A1 Oct. 2, 2008

Related U.S. Application Data

(60) Provisional application No. 60/908,718, filed on Mar. 29, 2007.

(51) Int. Cl.

| | |
|---|---|
| ***E04D 1/00*** | (2006.01) |
| ***E04F 13/00*** | (2006.01) |
| ***E04F 15/00*** | (2006.01) |
| ***E04F 19/00*** | (2006.01) |

(52) U.S. Cl. ..... 52/554; 52/311.1; 52/555; 52/749.12; 52/748.1

(58) Field of Classification Search ..... 52/554, 52/311.1, 518, 555, 560, 557, 749.12, 748.1
See application file for complete search history.

(56) References Cited

U.S. PATENT DOCUMENTS

| | | | | |
|---|---|---|---|---|
| 1,633,563 | A * | 6/1927 | Abbott | 144/13 |
| 2,015,084 | A * | 9/1935 | McQuade | 52/518 |
| 2,070,571 | A * | 2/1937 | Beasley | 428/142 |
| 2,241,603 | A * | 5/1941 | Kirschbraun | 52/560 |
| 4,288,959 | A * | 9/1981 | Murdock | 52/518 |
| 4,295,314 | A * | 10/1981 | Ferguson | 52/553 |
| 5,295,339 | A * | 3/1994 | Manner | 52/518 |
| 5,630,305 | A * | 5/1997 | Hlasnicek | 52/518 |
| 5,648,144 | A * | 7/1997 | Maurer et al. | 428/141 |
| 6,021,611 | A * | 2/2000 | Wells et al. | 52/98 |
| 6,112,492 | A * | 9/2000 | Wells et al. | 52/558 |
| 6,544,374 | B2 * | 4/2003 | King et al. | 156/260 |
| 6,808,785 | B1 | 10/2004 | Friedman et al. | |
| 6,955,019 | B2 * | 10/2005 | Donlin et al. | 52/520 |
| 6,972,149 | B2 * | 12/2005 | Kuipers et al. | 428/156 |
| 6,990,779 | B2 * | 1/2006 | Kiik et al. | 52/554 |
| 7,140,153 | B1 * | 11/2006 | Humphreys et al. | 52/173.3 |
| 7,141,200 | B2 * | 11/2006 | MacKinnon et al. | 264/515 |
| 7,141,201 | B2 * | 11/2006 | Kim et al. | 264/515 |
| 7,178,301 | B2 * | 2/2007 | Albright | 52/543 |
| 7,351,462 | B2 | 4/2008 | Friedman et al. | |
| 7,575,701 | B2 * | 8/2009 | Waggoner et al. | 264/154 |

(Continued)

*Primary Examiner* — Richard E Chilcot, Jr.
*Assistant Examiner* — Mark R Wendell
(74) *Attorney, Agent, or Firm* — Paul & Paul

(57) ABSTRACT

Synthetic shingles are made and treated, such that upper surfaces thereof that are to be weather-exposed in the installed condition, are scuffed, abraded, or scraped in such a manner that different visual appearances occur between abraded zones and unabraded (or lesser abraded) depressions, to enhance the natural-appearing materials that the synthetic shingles are designed to resemble. The shingles and the abrading medium have motion relative to each other. The abrading medium may take on various forms, such as a roller, a brush, a pad, etc. Some portions of the upper surface of the shingle remain unabraded, preferably being those portions that are depressed relative to higher portions of the shingle. The shingle may be of a single layer construction, or a multi-layer laminate.

15 Claims, 4 Drawing Sheets

U.S. PATENT DOCUMENTS

| | | | | |
|---|---|---|---|---|
| 7,631,461 | B2 * | 12/2009 | Shadwell et al. | 52/98 |
| 7,736,557 | B2 * | 6/2010 | Evans et al. | 264/74 |
| 7,785,510 | B2 * | 8/2010 | MacKinnon et al. | 264/148 |
| 2002/0001673 | A1 * | 1/2002 | Phillips | 427/180 |
| 2003/0054148 | A1 | 3/2003 | Jolitz | |
| 2004/0111996 | A1 * | 6/2004 | Heroneme | 52/518 |
| 2004/0241476 | A1 | 12/2004 | Friedman et al. | |
| 2005/0074581 | A1 * | 4/2005 | Albright | 428/151 |
| 2005/0086907 | A1 | 4/2005 | Jolitz | |
| 2006/0026908 | A1 * | 2/2006 | Gregori et al. | 52/105 |
| 2006/0029775 | A1 | 2/2006 | MacKinnon et al. | |
| 2009/0260309 | A1 * | 10/2009 | Humphreys et al. | 52/309.1 |

* cited by examiner

Fig. 2
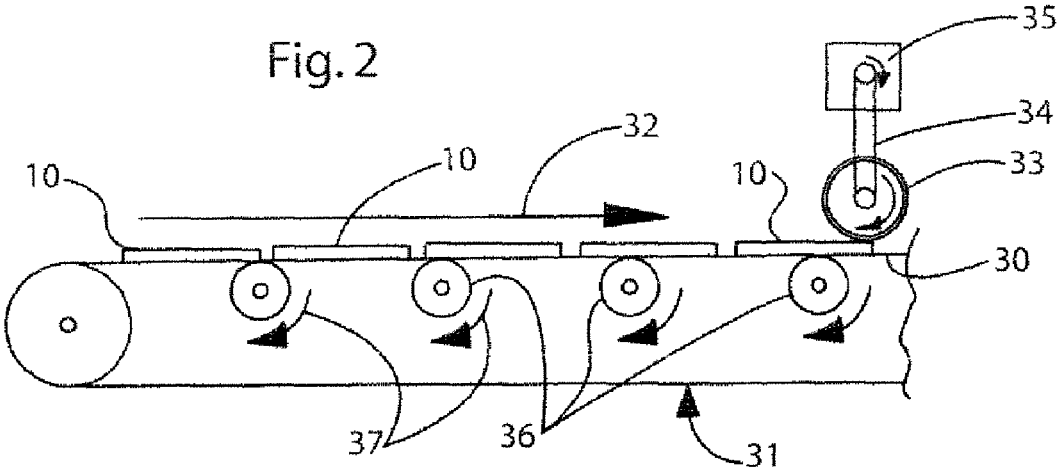
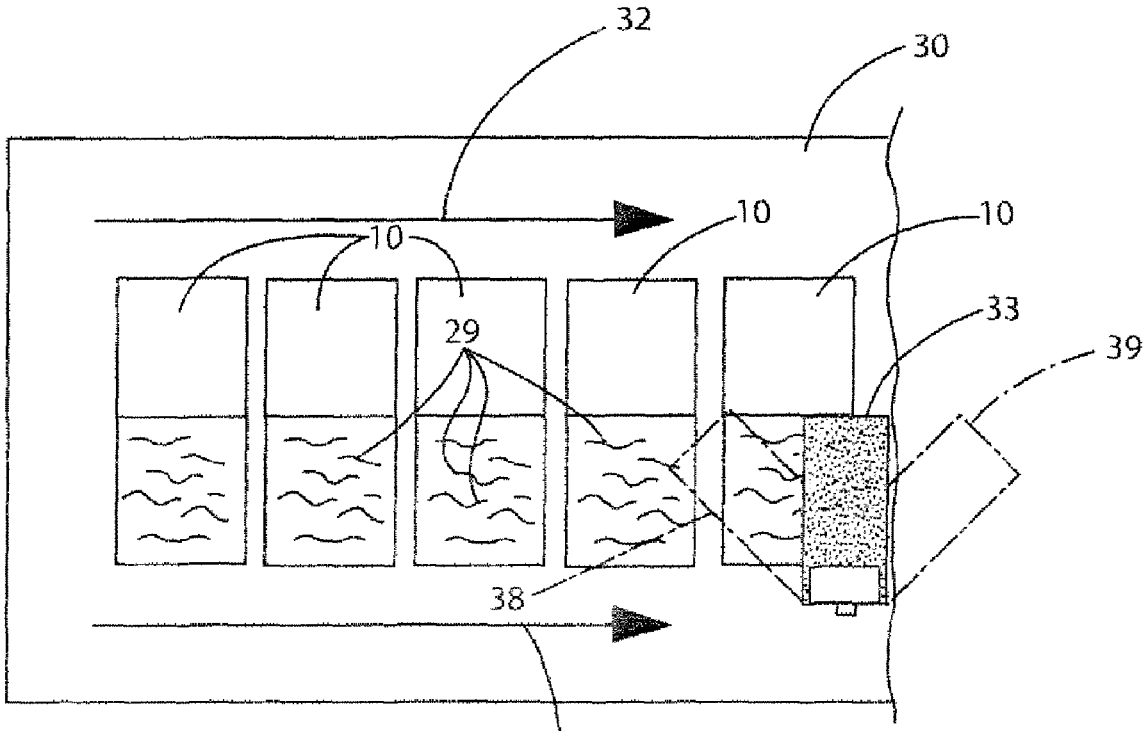
Fig. 3

PROCESS OF TREATING A SYNTHETIC SHINGLE AND SHINGLE MADE THEREBY

CROSS-REFERENCE TO RELATED APPLICATION

This application claims priority from provisional application Ser. No. 60/908,718, filed Mar. 29, 2007, the complete disclosure of which is herein incorporated by reference

BACKGROUND OF THE INVENTION

In the art of shingle manufacture, it was commonplace for many years that shingles were made of natural materials, such as slate, cedar shakes or made as tiles, from clay or like materials.

It has developed that natural-appearing shingles have been made by various molding and/or lamination processes whereby synthetic shingles have the appearance of natural slate shingles, natural wood shake shingles, or tiles.

Such synthetic shingles have a number of advantages, including the ability to build into the materials of construction of the shingle, various features, such as algae resistance, ultraviolet light resistance, color stabilizers and enhancers that are able to avoid discolorations by oxidation or other phenomena, heat reflectivity, and many other features.

When synthetic shingles are molded, the molding process allows one to provide surface irregularities that, while being intentionally planned and predetermined, yield in the final product the appearance of natural materials. For example, natural slate shingles do not generally haw completely uniform and smooth surfaces. Rather, they have minor depressions and irregularities. With the molding of synthetic shingles, such minor depressions and irregularities can be molded into the shingle.

THE PRESENT INVENTION

The present invention is directed to treating a synthetic shingle, on its upper surface, to enhance the effect of depth or texture, by creating a scuffing, or abrading of the upper surfaces that would normally be weather-exposed in the installed condition of the shingle on a roof, leaving depressions and recessed portions of the upper surface unscuffed, or unabraded, or scuffed or abraded a lesser amount than non-recessed portions, such that the areas of the upper surface of the shingle that are abraded (or more abraded) become somewhat lightened, creating an appearance more like natural materials, and in the case of a simulated slate shingle, creating the appearance of a shingle that has been rubbed against the surface of another slate shingle during handling, to yield a more pronounced texture that looks more like real stone or slate.

SUMMARY OF THE INVENTION

The present invention is therefore directed to a process for treating a synthetic shingle, in which a portion of the upper surface of the synthetic shingle that would ordinarily be weather-exposed in the installed condition, and in which the upper surface thereof would have high zones and a plurality of depressions, and wherein the high zones are abraded at least in some portions of them, with the depressions not being abraded or abraded a lesser amount, such that the upper surface of the weather-exposed portion of the shingle has different visual appearances in the abraded and unabraded surface portions.

In accordance with the present invention, a synthetic shingle is also provided having abrasions on an upper weather-exposed surface thereof, with depressions in that upper surface being free of abrasions therein, to create different visual appearances in the abraded surface portions and the unabraded surface portions.

Accordingly, it is a primary object of this invention to provide a novel process for treating a synthetic shingle by abrading portions of an upper surface thereof, while leaving unabraded other portions of the upper surface.

It is a further object of this invention to produce a different texture in a shingle made in accordance with the process set forth above.

It is yet another object of this invention to provide a shingle made in accordance with the process described above.

It is a further object of this invention to practice the above processes, and make a shingle in accordance with those processes, wherein shingles are delivered along a generally horizontal path in which they are engaged by an abrading medium as they are delivered along that path.

It is yet another object of this invention to provide a shingle in accordance with the description above, wherein the portion of the shingle that is to be weather-exposed comprises a laminate of at least two layers, and wherein the abrading occurs on the upper, outermost layer.

Other objects and advantages of the present invention will be readily apparent, upon a reading of the following brief descriptions of the drawing figures, the detailed descriptions of the preferred embodiments, and the appended claims.

BRIEF DESCRIPTION OF THE DRAWING FIGURES

FIG. 2 is, in fragmentary form, a schematic view of a plurality of shingles being treated in accordance with the process of this invention, as they are delivered along a predetermined path, beneath an abrading roller.

FIG. 3 is a top view of the schematic of FIG. 2, and wherein the abrading roller is shown in full lines mounted on an axis that is transverse to the direction of movement of the conveyor, with alternative mounting arrangements for the abrading roller being shown at various angular orientations, in phantom, as well.

DETAILED DESCRIPTIONS OF THE PREFERRED EMBODIMENTS

Figure 1:
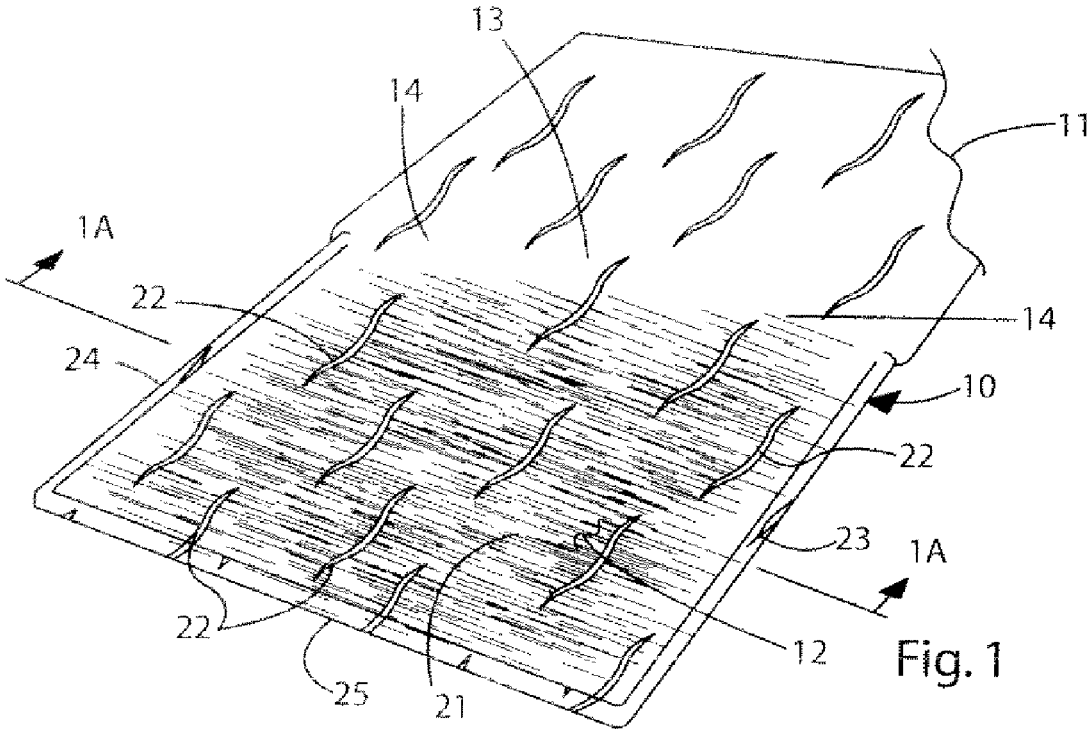
FIG. 1 is a top perspective view of a synthetic shingle in accordance with this invention.

Referring now to FIG. 1 in detail, it will be seen that the shingle 10 is generally shown as being a synthetic molded shingle, with the particular illustration of FIG. 1 being that of a simulated slate shingle. It will be understood that other natural forms, such as tiles, cedar shakes, or the like could comprise the aesthetic illustration for such materials, other than the simulated slate shingle shown in the illustration of FIG. 1. Thus, "shingle" as used herein embraces tiles and other roofing materials as well.

The shingle 10 includes a headlap portion 11, and a tab portion 12. The lower portion 12 of the shingle, below the separation line 13 comprises that portion of the shingle that would be mounted on a roof in such a way that it would be weather-exposed in the installed condition on a roof. A plurality of thinner shingle mounting zones 14 are shown, through which nails, staples, or other fasteners would be applied, to attach the shingle 10 to a surface of a roof.

Figure 1A:
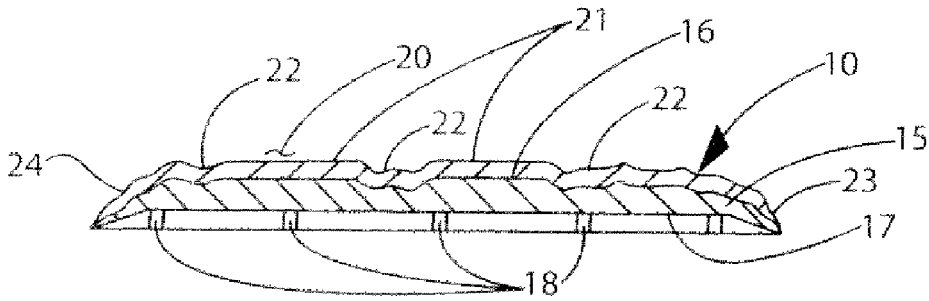
FIG. 1A is transverse sectional view of the shingle of FIG. 1, taken generally along the line 1A-1A of FIG. 1.

The tab portion 12 of the shingle 10, is shown in transverse section in FIG. 1A, to preferably comprise a core layer 15, and a capstock layer 16, although a single material layer or multiple other layers could comprise the shingle or tile, as may be desired. The core layer 15 will normally be constructed of a material such as polypropylene, that is of lesser expense than the material 16 of construction of the capstock material. The layer 16 may also be a polypropylene or other suitable material. The layer 15, will preferably have inexpensive fillers therein, and the layer 15 will normally be substantially thicker than the capstock layer 16. The capstock layer 16 may be treated to have various features included therein, such as ultraviolet resistance, color retention chemicals, anti-fungal treatments, anti-algae treatments, anti-oxidants, and the like, to facilitate product longevity and enhance the aesthetics of the shingle 10. The bottom surface 17 of the core layer may have various supporting ribs 18, for supporting the shingle 10 on a roof, when it is nailed or otherwise secured to the roof.

The upper surface 20 of the capstock layer 16 will preferably have various irregularities molded into it, such as high zones 21 and depressions 22.

Right and left side edges 23 and 24 respectively, and lower edge 25 of the shingle 10 will likewise be chamfered as shown.

The high zones 21 are the zones that will receive abrasive treatment in accordance with this invention. The depressions 22 on the upper surface 20 of the shingle 10, are the portions of the upper surface of the shingle that will not be abraded, or will be abraded a lesser amount. Thus, as the shingle 10 is viewed, there will be some portions that have been abraded and some portions that are not abraded, or are abraded a lesser amount for the greater and lesser (or unabraded) portions, giving different visual appearances. These different visual appearances will preferably produce different apparent textures, such that the abraded or scuffed surface portions may appear lighter in color or contrast than the unabraded or unscuffed depressions, the latter of which will normally appear somewhat darker. This has the effect of accentuating the texture and giving the shingle a look of more depth or texture. Additionally, the areas that are lightened by being scuffed or abraded appear more like real stone or slate that has been rubbed against the surface of another stone or slate during handling.

With reference to FIG. 2, it will be seen that one technique for making the shingle of FIGS. 1 and 1A will be to deliver molded shingles 10 along a predetermined path provided by the upper run 30 of a conveyor 31, in the direction for example of the arrow 32, such that the shingles 10 are delivered beneath an abrading roller such as that 33 of the cylindrical type, which, in turn, is driven by means of a belt or other mechanism 34 from a motor or the like 35. The upper run of the belt 30 is supported by various rollers 36, driven in the direction of the arrows 37, such that the relative motion between the belt-driven shingles 10 and the rotating cylindrical abrading roller 33 will produce the scuffing or abrasions 29 shown on the upper surfaces thereof, as the shingles 10 are delivered beneath the abrading roller 33.

It will be noted that the abrading roller 33 is shown in full lines in FIG. 3. It will also be noted that the abrading roller 33 is shown in two alternate angled dispositions 38 and 39, in phantom, to represent other angled positions by which the abrading roller 33 may provide abrasions or scuffing on the upper surfaces of the shingles 10 as the shingles 10 move therebeneath, against the abrading roller 33. It will be understood that the abrading roller 33 may be moved among the various full line and phantom positions, or even other positions as the shingles move therebeneath, to yield different angles of scrapes, roughness, scuffing or abrading on the high shingle surfaces that are to be abraded as the shingles are moved relative to the abrading roller 33.

It will further be understood that, while it is preferred that the shingles will be moved beneath a rotating abrading roller 33, it is also possible that the shingles could be maintained stationary and the relative motion between an abrading medium and the shingles could be accomplished by moving the abrading medium, such as a roller 33 or some other medium relative to the upper surfaces of the shingles 10.

Figure 4A:
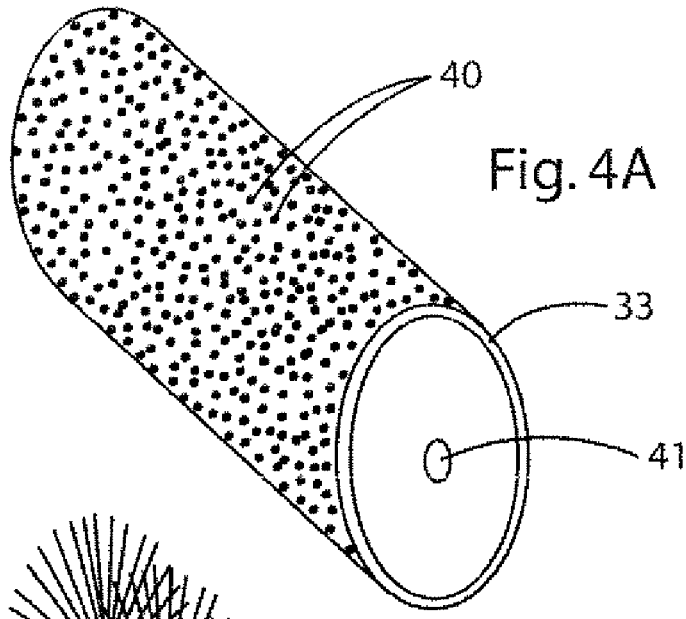
FIG. 4A is a perspective view of one form of abrading roller in accordance with this invention.

With reference to FIG. 4A, it will be seen that the abrading roller 33 is disposed with various abrading media 40 on an upper surface thereof, and that an axis 41 is provided about which rotation of the abrading roller 33 would occur.

Figure 4B:
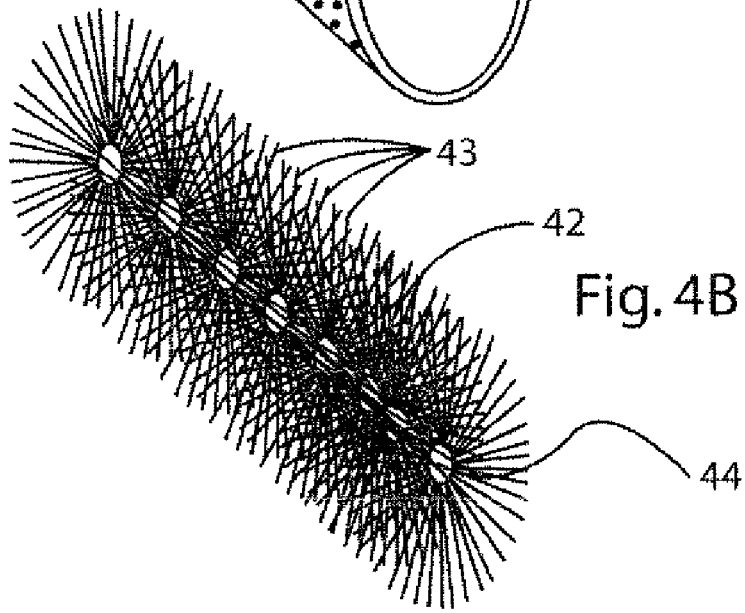
FIG. 4B is a perspective view of another form of an abrading medium, in the form of a wire-like cylindrical abrader.

With reference to FIG. 4B, an alternative form of an abrading medium is provided, in the form of a generally cylindrically configured wire brush 42, comprised of a plurality of wires 43, again shaft-mounted for rotation about an axis 44, in the same manner as described above for the roller 33 with respect to FIGS. 2 and 3.

Figure 4C:
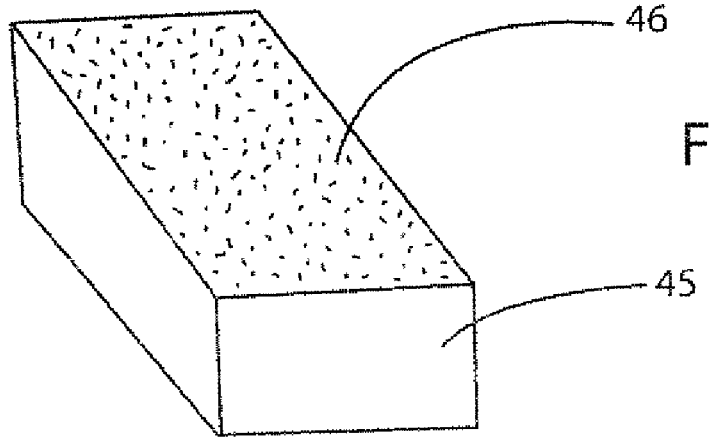
FIG. 4C is a perspective view of an abrading pad in accordance with this invention, for abrading shingles, but wherein the abrading surface of the pad is shown facing upwardly, for clarity of illustration, it being understood that if shingles are to be abraded thereby, the abrading pad of FIG. 4C would normally be mounted in an inverted position, to abrade shingles passing therebeneath.

With reference to FIG. 4C, it will be seen that the abrading medium 45 is shown in the form of a brush, having an abrading surface 46 facing upwardly. This disposition of the abrading brush 45 in FIG. 4C is for purposes of illustration only, it being understood that if the brush 45 were mounted in a system such as that of FIGS. 2 and 3, the abrading surface 46 would face downwardly, such that it could scrape the upper surfaces of the weather-exposed portions of the shingles 10 as the shingles are moved relative to the brush 45.

Figure 5:
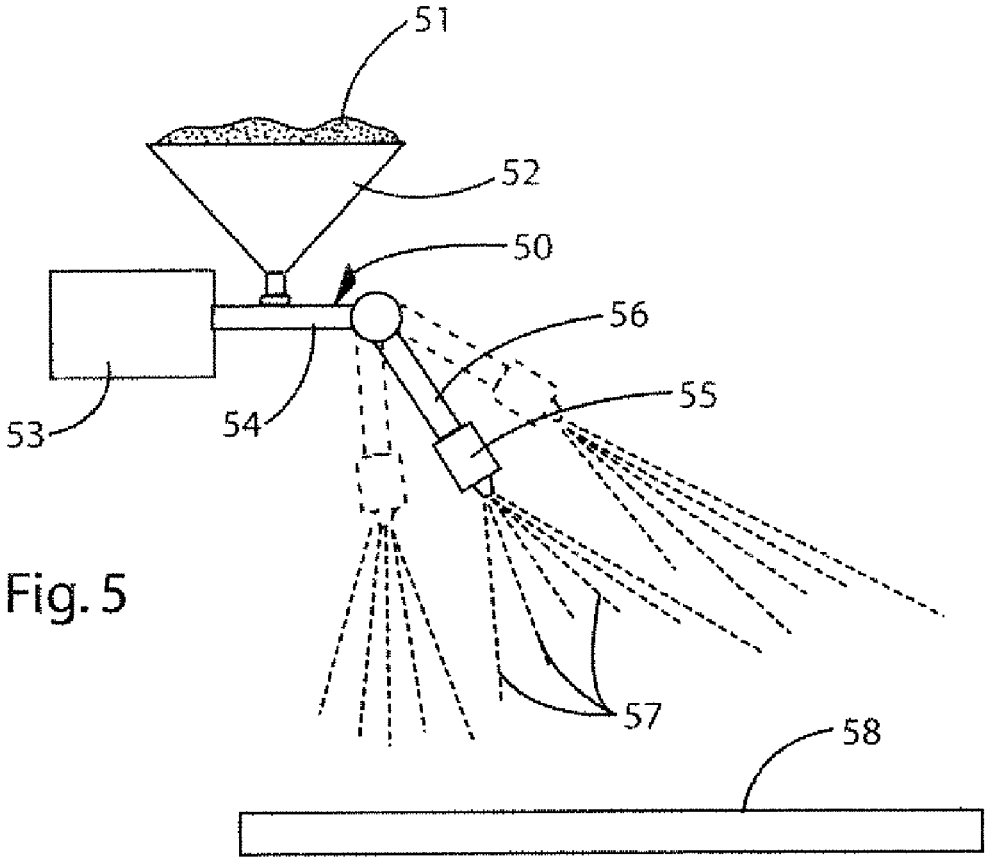
FIG. 5 illustrates an abrading mechanism for a shingle, tile or the like in the form of a sand, water, bead or other particle abrasion apparatus, in schematic form.

FIG. 5 illustrates a particle abrader mechanism 50, for receiving sand, glass, water or other particles 51 therein in a hopper 52 of the mechanism 50, whereby a motor 53 may activate a drive rod 54, for driving an abrading nozzle 55, via a conduit 56, between the full line position shown and the phantom positions shown, such that particles 57 may be used to abrade a shingle 58 or the like, throughout various abrading angles as shown, which motor 53 may be computer driven, if desired, to yield various angles of incidence, for abrading the upper surface of the shingle 58 to have different levels of abrading, for different portions thereof. It will be understood that the shingle 58, while being shown to have a plain upper surface could alternatively have variations in its surface, with recesses and peaks, as may be desired, as shown by way of example in FIG. 1, or of any other configurations. It will also be understood that the control for the motor 53, via computer or the like, could be programmed to yield lighter and darker zones of abrasion on the shingle, or to achieve any of a variety of special effects, such as differential amounts of abrasion, or portions of no abrasion relative to portions of abrasion or a greater amount of abrasion, all as may be desired.

Figure 6:
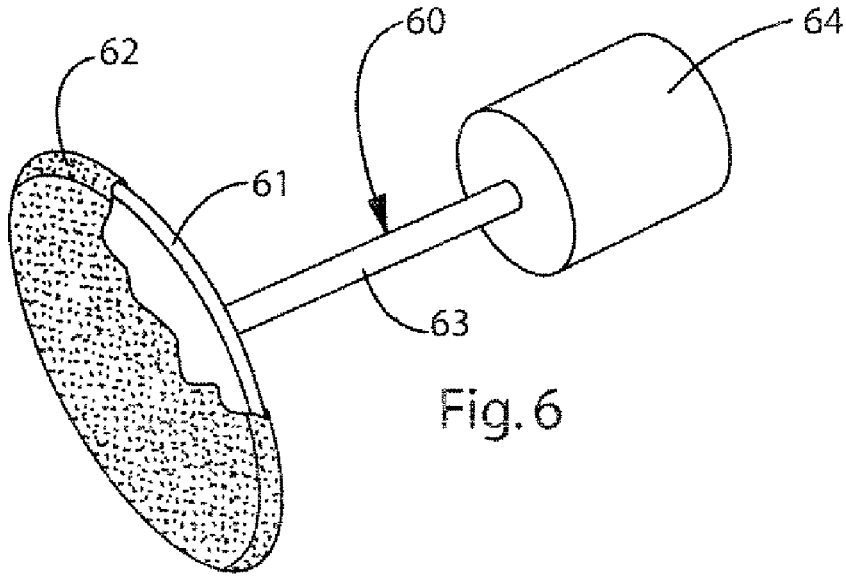
FIG. 6 is a perspective illustration of a motor-driven abrading wheel of the somewhat flexible type, for lightly abrading recessed portions of a shingle or tile, while also abrading non-recessed portions a greater amount.

With reference to FIG. 6, it will be seen that an abrading mechanism is shown in the form of an abrading wheel 61, of a relatively soft material, such as rubber or the like, having an abrading medium 62 of sandpaper, grit or the like particles applied thereto, with the mechanism 60 being shaft driven at 63 for rotation by means of a motor 64 or the like, such that the abrading medium 62 of the wheel 61, can engage a surface having higher and lower points, such as that illustrated in FIGS. 1 and 2, and can provide differential levels of abrasion depending upon the depth of the surface portion, as may be desired.

It will thus be understood that in a preferred form of this invention, the shingles are delivered serially along a predetermined path, and that a rotating or stationary abrading medium of some form is engaged against the high surfaces of the shingles that are desired to be abraded, leaving the lower surface portions of the upper surface of the shingle that comprise the depressions, unabraded, such that abrading is avoided with respect to those depressions, so that they remain free of abrasions. It will further be understood that although cylindrical and disc type abrasion devices are depicted in figures, an abrasive pad such as a nonwoven abrading medium may be employed, and may operate like any of the mediums of FIGS. 4A, B, C and/or 6, as may be desired.

It will be apparent from the foregoing that various modifications may be made in the details of construction, as well as in the use and operation of the process of this invention, all within the spirit and scope of the invention as defined in the appended claims.

What is claimed is:

1. A process of treating a synthetic shingle having upper and lower surfaces, in which the shingle is adapted to be mounted on a building surface with its lower surface facing the building surface and with at least a portion of the upper surface being weather-exposed, comprising the steps of:

a) providing a synthetic shingle having an upper surface with high zones and a plurality of depressions therein;

b) abrading at least portions of the high zones of the upper surface; and c) treating at least some of the depressions in the upper surface by any one of:

(i) avoiding abrading the depressions; and (ii) abrading at least some of the depressions a lesser amount than the high zones;

d) whereby the upper surface of the shingle has different visual appearances in the abraded at least portions of the higher zones than the unabraded depressions.

2. The process of claim 1, wherein the abrading step produces a different texture for the abraded portions than the unabraded depressions.

3. The process of any of claim 1-2, including the step of:

e) delivering the shingles serially along a predetermined generally horizontal path; and f) engaging the shingles with an abrading medium as they are being delivered along the generally horizontal path.

4. The process of claim 3, wherein the engaging step includes passing the shingles under an abrading roller.

5. The process of claim 3, wherein the abrading step includes passing the shingles by an abrading pad.

6. The process of claim 3, wherein the abrading step includes passing the shingles by an abrading disc.

7. The process of claim 3, wherein the abrading step includes passing the shingles by an abrading brush.

8. The process of claim 3, wherein the abrading step includes striking the shingles via particles delivered to the shingles via a particle abrader.

9. A process of treating a synthetic shingle having upper and lower surfaces, in which the shingle is adapted to be mounted on a building surface with its lower surface facing the building surface and with at least a portion of the upper surface being weather-exposed, comprising the steps of:

a) providing a synthetic shingle having an upper surface with high zones and a plurality of depressions therein;

b) abrading at least portions of the high zones of the upper surface; and c) with the depressions in the upper surface being abraded a lesser amount than the level of abrasion of the high zones;

d) whereby the upper surface of the shingle has different visual appearances in the abraded at least portions of the higher zones than the unabraded depressions.

10. A synthetic shingle having upper and lower surfaces, in which the shingle is adapted to be mounted on a building surface with its lower surface facing the building surface and with at least a portion of the upper surface being weather-exposed, wherein:

(a) the shingle has an upper surface with high zones and a plurality of depressions therein;

(b) with at least portions of the high zones of the upper surface having abrasions therein;

(c) with the depressions in the upper surface being free of abrasions therein;

(d) whereby the upper surface of the shingle has different visual appearances in the at least portions of the higher zones having abrasions therein than in the depressions that are free of abrasions therein.

11. A synthetic shingle having upper and lower surfaces, in which the shingle is adapted to be mounted on a building surface with its lower surface facing the building surface and with at least a portion of the upper surface being weather-exposed, wherein:

(a) the shingle has an upper surface with high zones and a plurality of depressions therein;

(b) with at least portions of the high zones of the upper surface having abrasions therein;

(c) with the depressions in the upper surface being abraded a lesser amount than the high zones;

(d) whereby the upper surface of the shingle has different visual appearances in the at least portions of the higher zones than the unabraded depressions.

12. The shingle of any one of claims 10 and 11, wherein the at least portions of the high zones of the upper surface that have abrasions therein have a different texture than the texture of the depressions.

13. The shingle of any one of claims 10 and 11, wherein a portion of the shingle is adapted to be weather-exposed comprises a laminate of at least two layers, with a first layer comprising an upper layer and including the upper surface of the shingle, and a second layer comprising a lower layer and including the lower surface of the shingle.

14. The shingle of claim 13, wherein the second layer includes supporting ribs comprising at least a portion of its lower surface.

15. The shingle of any one of claims 10 and 11, wherein the at least portions of the high zones of the upper surface that have abrasions therein have a different texture than the depressions, wherein a portion of the shingle is adapted to be weather-exposed comprises a laminate of at least two layers, with a first layer comprising an upper layer and including the upper surface of the shingle, and a second layer comprising a lower layer and including the lower surface of the shingle, and wherein the second layer includes supporting ribs comprising at least a portion of its lower surface.

* * * * *

UNITED STATES PATENT AND TRADEMARK OFFICE

CERTIFICATE OF CORRECTION

PATENT NO. : 7,934,346 B2
APPLICATION NO. : 12/043185
DATED : May 3, 2011
INVENTOR(S) : Thomas Kevin MacKinnon et al.

It is certified that error appears in the above-identified patent and that said Letters Patent is hereby corrected as shown below:

Column 1, line 31, delete “haw” insert --have--.

Signed and Sealed this
Fifth Day of July, 2011

David J. Kappos

David J. Kappos
*Director of the United States Patent and Trademark Office*